US005435381A

United States Patent [19]

Downing et al.

[11] Patent Number: 5,435,381

[45] Date of Patent: Jul. 25, 1995

[54] SHEAR FLOW/JET FIN CONDENSER

[75] Inventors: Robert S. Downing; Timothy Bland; Martha J. Campbell; John M. VanDyke, all of Rockford, Ill.

[73] Assignee: Sundstrand Corporation, Rockford, Ill.

[21] Appl. No.: 583,396

[22] Filed: Sep. 14, 1990

[51] Int. Cl.[6] ..... F28B 1/00; F28F 3/08

[52] U.S. Cl. ..... 165/110; 165/903; 165/908

[58] Field of Search ..... 165/110, 908, 903, 913

[56] References Cited

U.S. PATENT DOCUMENTS

| | | | |
|---|---|---|---|
| 4,370,868 | 2/1983 | Kim et al. | 62/515 |
| 4,494,171 | 1/1985 | Bland et al. | 165/908 |
| 4,586,565 | 5/1986 | Hallstrom et al. | 165/167 |
| 4,762,171 | 8/1988 | Hallstrom et al. | 165/167 |
| 4,775,007 | 10/1988 | Sakuma et al. | 165/908 |
| 4,880,055 | 11/1989 | Niggemann et al. | 165/908 |
| 4,936,380 | 6/1990 | Niggemann | 165/908 |

FOREIGN PATENT DOCUMENTS

| | | | |
|---|---|---|---|
| 115983 | 7/1984 | Japan | 165/903 |

*Primary Examiner*—Martin P. Schwardron
*Assistant Examiner*—L. R. Leo
*Attorney, Agent, or Firm*—Whitham, Curtis, Whitham & McGinn

[57] ABSTRACT

A compact, rugged and light weight condenser structure for a heat exchange system, preferably fabricated in layers and incorporating a jet fin structure for heat exchange with a single phase coolant fluid and tapered passages to maintain relatively constant vapor flow velocity and a consistent, high efficiency flow regime in a refrigerant fluid including vapor and liquid phases. Layered construction permits economical fabrication of the condenser in a plurality of configurations and heat exchange capacities. Tapered configuration of the refrigerant passages, together with the consistent distribution of jet fin heat exchange to the coolant allows a flow regime to be maintained which is highly tolerant of variation in the direction and force of acceleration forces on the condenser. Accordingly, a condenser capable of highly consistent heat exchange performance over a wide range of acceleration conditions is provided.

18 Claims, 11 Drawing Sheets

PLATE A

PLATE B

PLATE C

PLATE D

SHEAR FLOW/JET FIN CONDENSER

BACKGROUND OF THE INVENTION

1. Field of the Invention

The present invention generally relates to heat exchangers and particularly to condensers for maintaining high heat transfer during a phase change of a fluid being cooled under adverse inertial loading.

2. Description of the Prior Art

Devices for providing a transfer of heat to or from a fluid have long been known. Similarly, devices for transferring heat between two fluids while largely preventing mixing or even contact between the fluids are familiar to most people. An automobile radiator would be a commonly recognized examples of such a device.

More modern developments in environmental controls, refrigeration and other thermal control systems and energy management systems have prompted the development of arrangements capable of absorbing heat at one location and discharging it at another through the use of a fluid commonly referred to as a refrigerant which may or may not undergo a phase change in the process. As is well known, the basic elements of such a system include a compressor which raises the pressure and, hence, the temperature of the refrigerant, a condenser which removes the heat from the compressed refrigerant and typically causes a phase change of a portion of the mass of the refrigerant from a gas to a liquid, and an evaporator in which heat is absorbed during reversion of the refrigerant from the liquid phase to the vapor phase.

Various arrangements which effectively increase the surface area of a heat exchanger will improve the thermal performance thereof. Direction of a fluid over the surface of such a device will also enhance the possible rate of heat exchange for a given temperature differential between the heat exchanger and the fluid. It has been recently found that the direction of a jet of fluid at a surface of the heat exchanger provides a beneficial degree of turbulence to enhance heat transfer. This has led to the development of the jet fin type of heat exchanger where a plurality of apertured plates are provided in a generally parallel arrangement. The aperture locations in sequential ones of the plates are skewed from each other so that each aperture forms a jet which directs a fluid against a solid portion of the next plate. U.S. Pat. Nos. 4,494,171, to Bland et al. and 4,880,055, to Niggemann et al, both assigned to the assignee of the present invention, are typical of jet fin heat exchanger structures.

While jet fin heat exchangers exhibit enhanced heat transfer coefficients, and enhanced heat transfer surface area per unit volume of the heat exchanger, they are not well suited to a condenser structure since the existence of plural phases of a fluid will interfere with flow within the jets due to differences in viscosity of the liquid and vapor phases. While the geometry of a jet fin heat exchanger can be reasonably optimized for either a liquid or a vapor phase fluid (e.g. a small range of viscosity) to be circulated therethrough, two phases of greatly differing viscosity cannot be efficiently accommodated and, in practice, jet fin heat exchangers are typically designed only for liquid phase fluids in aircraft applications.

In the condenser element, with which the present invention is principally concerned, heat transfer from the high-temperature compressed gas to the condenser structure an thence to another fluid may be impeded by the phase and the nature of the refrigerant flow within refrigerant-containing passages of the condenser. Generally, the heat transfer rate is limited by the thickness of condensed liquid phase refrigerant on the passage walls which will change with the type of flow (e.g. flow regime) which is present in the passages. The relative amount of vapor in the total fluid mass (vapor and liquid) is generally referred to as the quality of the fluid in a given volume thereof and will affect the heat transfer rate, as well. The presence of non-condensible gases will also reduce the efficiency of the condenser by displacing condensible vapor. The heat transfer rate will also be affected by the rate of liquid phase flow which must, in turn, be propelled by the vapor phase flow or by gravity. Types of two-phase flow generally encountered in condensers, in order of generally decreasing heat transfer coefficient are as follows:

- Mist annular flow—same as annular flow with condensed liquid phase refrigerant droplets which are pulled off the liquid phase surface and entrained in the vapor phase, reducing the thickness of the liquid annulus;
- Annular flow—flow during which all interior surfaces of the passages are wetted with condensed vapor, thus presenting an annular cross-section of liquid phase refrigerant;
- Semi-annular flow—similar to annular flow but where the thickness of the liquid phase layer is not uniform and possibly great enough for the existence of wave-like turbulence to exist due to the vapor velocity;
- Stratified flow—a typically gravity dominated flow where not all interior surfaces of the passages are wetted by the liquid phase refrigerant (e.g. liquid phase refrigerant collects at only a portion of the interior passage surface circumference)due to the forces of the gravity field; and
- Slug flow—flow where liquid phase of the refrigerant collects at only a portion of the passage length, leaving some interior passage surface areas relatively unwetted with liquid and vapor phases alternately filling the passage cross-section. Slug flow in a normal gravity field would appear as a wavy stratified flow with a majority of wave tops reaching the tops of the conduit to fill the cross-section thereof. In a low gravity field, shear forces will dominate and the flow will resemble annular flow in some portions of the conduit and plug flow in others.
- Plug Flow—similar to slug flow at particularly low values of "quality"; the ratio of vapor phase mass to liquid phase mass. In a normal gravity field, this would appear as a largely fluid filled conduit with bubbles of vapor phase near an upper boundary of the conduit. In a low gravity field the bubbles would be entrained in the liquid, but of such small size that heat transfer would resemble that of a liquid-filled conduit due to the thickness of the liquid phase layer surrounding the bubbles.

Slug flow is generally classified into two types. So-called high velocity slug flow is generally shear force dominated and so-called low velocity slug flow is generally gravity field dominated. This terminology is used to indicate the relative dominance of shear forces or gravity field forces since, in a normal gravity field (e.g. approximately 1 g), the relative dominance of these forces will depend upon the velocity of the flow. However, in a reduced gravity field, as would be encountered in spacecraft, a much reduced velocity would result in so-called high velocity type slug flow. At high flow velocities or low gravity field, bullet-shaped Taylor bubbles will form due to the dominance of shear forces. As indicated above, the flow regime at the location of a Taylor bubble will resemble annular flow and locations between bubbles will resemble liquid flow. Heat transfer in a so-called high velocity slug flow can be approximated by pro-rating the heat transfer of these two flow regimes over the length of the conduit based on the proportion of the length of the conduit containing Taylor bubbles to the length filled with liquid phase fluid. Generally, heat transfer will remain good in a high velocity slug flow regime.

As can be readily appreciated, the above order corresponds to increasing thickness, decreasing area of the liquid phase wetting the interior surface of the passage and/or reduced ability of the liquid phase to be driven through the passage by the vapor phase. All of these conditions adversely affect the efficiency of heat transfer from the two-phase fluid to the walls of the passage. Therefore, it is seen that the type of flow within a condenser passage containing a refrigerant in two phases can severely affect the performance of the condenser and the system in which it is installed. By the same token, the above order of flow regimes reflects decreasing shear force dominance and increasing gravity or inertial force dominance. Accordingly, alteration of the flow regime due to changes in acceleration of a condenser can have serious adverse effects on the performance of the condenser, as will now be explained.

Referring briefly now to FIG. 7, a flow regime map assuming a normal gravity field of 1 g is illustrated. The flow pattern or regime in a channel or conduit depends on several parameters including flow rate, quality, fluid properties and heat transfer. In order to determine analytically what flow regime the condenser is in, a two-phase flow regime parameter is calculated. Also, the quality of the fluid will change over the length of a condenser passage and the shear forces within the fluid will be different for the liquid and vapor phases, resulting in different pressure drops within the conduit over an incremental portion of the length of the conduit. It is therefore useful to plot such a parameter against the Martinelli parameter, X, which is a function of the ratio of the pressure drop over an incremental length of the conduit attributable to the liquid phase to the pressure drop over an incremental length of the conduit attributable to the vapor phase. Although the relationship between the quality of the fluid and the Martinelli parameter, X, is complex, high values of quality (mostly vapor) will correspond to low values of the Martinelli parameter and vice-versa.

One useful parameter for understanding the invention and the flow regimes depicted in FIG. 7 is the Froude number, Fr, which is a function of the mass velocity, quality, hydraulic diameter of the conduit, vapor and liquid densities and the acceleration, such as gravity field. The Froude number is well-understood and accepted in the art as an indicator, inter alia, of the ratio of shear forces to acceleration forces and will be used herein to include approximations of the Froude number, often referred to as a modified Froude number. The Froude number will vary directly with the quality and mass velocity and inversely with the square root of the gravitational field, vapor and liquid density and the hydraulic diameter of the conduit. If the Froude number, Fr, is graphed against the independent Martinelli parameter, X, the flow regime in any given portion of a condenser passage can be predicted. The various dotted and dashed lines of FIG. 7 depict the approximations of flow regime transition points published by different researchers, identified in the key contained in FIG. 7, and will be familiar to those skilled in the art.

The more important transitions shown in FIG. 7 are the curves attributed to Taitel and Dukler and Sardesai et al, both of which depict the approximate transition between stratified or gravity-dominated flow and annular or shear force dominated flow. These curves also divide the slug flow regime and approximate the transition between low-velocity or gravity dominated slug flow from high-velocity or shear force dominated slug flow. As indicated above in the description of different types of flow regimes, these curves and preferably the curve attributed to Sardesai et al are also considered to be reliable indicators of a sharp change in heat transfer efficiency.

It has also been long-recognized that the condensation of a vapor and, to a lesser extent, the reduction in temperature of a vapor reduces the volume of the vapor and, hence, the mass velocity. Therefore the Froude number may change with location within the conduit due to change in quality during condensation or change of mass velocity within the conduit or both. Since higher values of quality will be associated with lower values of Martinelli parameter, the flow from inlet to outlet within a condenser conduit will fall on some locus of points extending generally left to right across the flow regime map of FIG. 7. In a condenser application, Froude number would tend to decrease with increasing Martinelli parameter at least because of the change in fluid quality due to condensation as the fluid progresses through the length of the conduit.

Change of flow regime from one type of flow to another at any point in the passage may, in turn, cause deterioration or change of flow regime over the entirety of the passage. For instance, if slug flow were to occur at an end of the passage, due to decrease of vapor flow velocity and/or gravity, the resulting decrease in vapor flow rate would cause a change of flow regime throughout the passage. This is because deterioration of flow regime increases viscous drag of the fluid and a higher pressure would be required to maintain a given mass velocity once the flow regime has deteriorated at any point within the conduit. Such change of flow regime is unavoidable in condensers of high efficiency heat transfer systems since the greatest amount of heat will be absorbed during evaporation if the fluid is mostly or entirely liquid at the outlet of the condenser. Accordingly, the flow regime at the outlet of the condenser must be well within or even substantially toward the right side of the slug or plug flow areas depicted in FIG. 7 and the locus of points indicating the flow regime within the conduit will necessarily traverse the slug or plug flow areas of the flow regime map.

The use of tapered passages to alter flow rate is known, such as in U.S. Pat. Nos. 4,586,565 and 4,762,171, to Hallstrom et al. to compensate for changes in fluid volume and to adjust flow rate but such implementations have been directed to controlling flow velocity in evaporators. Velocity control has thus been accomplished by providing increasing area of the passages at the expense of reducing flow area in adjacent channels. These arrangements are therefore of greater than optimal volume and difficult to optimize since heat exchange rate will vary over the length of the passages due to the change of flow area in adjacent channels. It is also to be noted that the devices of the Hallstrom patents have a preferred operational orientation, implying sensitivity to the gravitational field and, hence, to acceleration forces of all kinds, including vibration.

The susceptibility to alteration of condenser performance by flow regime is especially critical in aircraft and aerospace applications where the direction and force of accelerations vary widely and gravity cannot be reliably exploited to enhance refrigerant flow. Moreover, in high performance aircraft, heat exchange requirements may be greatest at the same time when gravity or acceleration loads and power requirements other than for the compressor of the heat exchange system are high. Such applications also require light weight construction and compactness of the condenser structure.

Therefore a need exists for a condenser structure which will retain an efficient two phase flow regime and remain functionally unaffected under severe acceleration loads while being light, rugged and compact in construction and capable of being economically manufactured in a plurality of configurations for specific applications.

SUMMARY OF THE INVENTION

It is therefore an object of the present invention to provide a condenser structure adapted to transfer heat from a two-phase fluid to a one phase fluid with high efficiency.

It is a further object of the invention to provide a condenser structure which will maintain an annular flow in passages carrying a two phase fluid in a high acceleration load tolerant manner.

It is a another object of the invention to provide a condenser structure which greatly increases heat transfer area for transferring heat to a single phase fluid and using a jet fin arrangement to further enhance heat transfer.

It is another further object of the invention to provide a condenser structure which will establish optimum propulsion of the liquid phase of a fluid by a vapor phase of the fluid during condensation.

It is yet another object of the invention to provide a structure and method of assembly which assures rugged and lightweight construction in a plurality of configurations in an economical manner.

To accomplish the above and other objects of the invention according to one aspect thereof, a condenser of a heat exchange system is provided comprising, in combination, a jet fin structure for heat exchange with a single phase coolant, and at least one refrigerant-confining passage for heat exchange with a two phase refrigerant; the jet fin structure and the refrigerant-containing passage being in thermal communication with each other.

In accordance with another aspect of the invention, a method of forming a heat exchanging structure from lamina is provided wherein the lamina are apertured in a plurality of different patterns in areas corresponding to a refrigerant-containing passage and a jet fin structure, comprising the steps of positioning at least two types of layers in a predetermined sequence, bonding said at least two of said first, second, third and fourth types of layers together, and forming at least two openings in an edge of at least one of layer in a position to communicate with the refrigerant containing passage.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
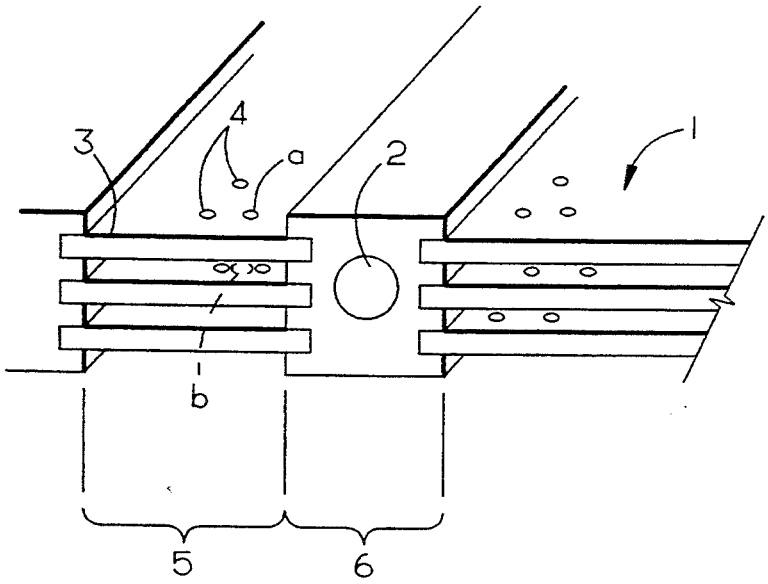
FIG. 1 is an isometric view of the invention including salient features of the invention.

Referring now to the drawings, and more particularly to FIG. 1, there is shown an illustration of the salient features of the invention including heat exchanger structure 1. This heat exchanger structure includes a refrigerant-containment structure 6 and a jet fin structure 5 combined so as to provide a thermal communication or connection therebetween.

In the following description, the term "refrigerant⇄ will be applied to the fluid which may exist in a two-phase form within the condenser structure and is circulated through refrigerant containing structure 6. Similarly, the term "coolant" will be used to refer to a fluid which remains in a single phase during circulation through jet fin structure 5. These terms are not intended to necessarily infer a difference in chemical composition between the refrigerant and the coolant although they will, typically, be different.

Jet fin structure 5 is, per se, well understood in the art and reference is made to U.S. Pat. Nos. 4,494,171 to Bland et al and 4,880,055 to Niggemann et al, which are assigned to the assignee of the present invention and hereby fully incorporated by reference, for detailed discussion thereof. Briefly, however, the jet fin structure is formed by a plurality of spaced lamina or layers 3 having apertures therein. The apertures 4 in each layer 3 are preferably skewed in location from the positions of apertures on adjacent lamina so that each aperture will form a jet of fluid at position a which will impinge on area b, denoted generally by a dashed circle. Projecting the jet in a direction perpendicular to the subsequent lamina has been found to produce optimum turbulence for enhancement of heat transfer and, most preferably, the jet apertures 4 will be formed perpendicular to the succeeding lamina, even if this results in formation of the aperture at an angle within a given lamina. For greatest compactness, however, it is preferable to position the lamina in a parallel fashion and to form the apertures perpendicular to the surface thereof. However, depending on shaping or surface treatments applied to lamina 3, angled apertures may be desirable.

Refrigerant-confining structure 6 is a structure which forms one or more refrigerant-confining passages 2 which are preferably tapered to decrease the cross-sectional area thereof in the direction of flow for reasons which will be discussed in more detail below. Basically, the taper is for the purpose of maintaining a relatively constant flow rate within passage 2, notwithstanding changes in volume due to condensation and reduction in temperature of the refrigerant fluid, although changes in temperature are slight and due to changes in pressure.

Thermal connection or communication may be provided between jet fin section 5 and refrigerant-confining section 6 by any of a plurality of known means including formation in an integral fashion from the same piece of material, or positioning the jet fin lamina, possibly by a slotted structure, as illustrated, together with some form of heat conductive bonding of the sections 5 and 6. Alternatively, the combination structure may be formed of lamina having recesses which may be formed, for instance, by etching, abrading, casting, embossing, etc., forming galleries and passages, as well as apertures forming the jets.

Figure 2:
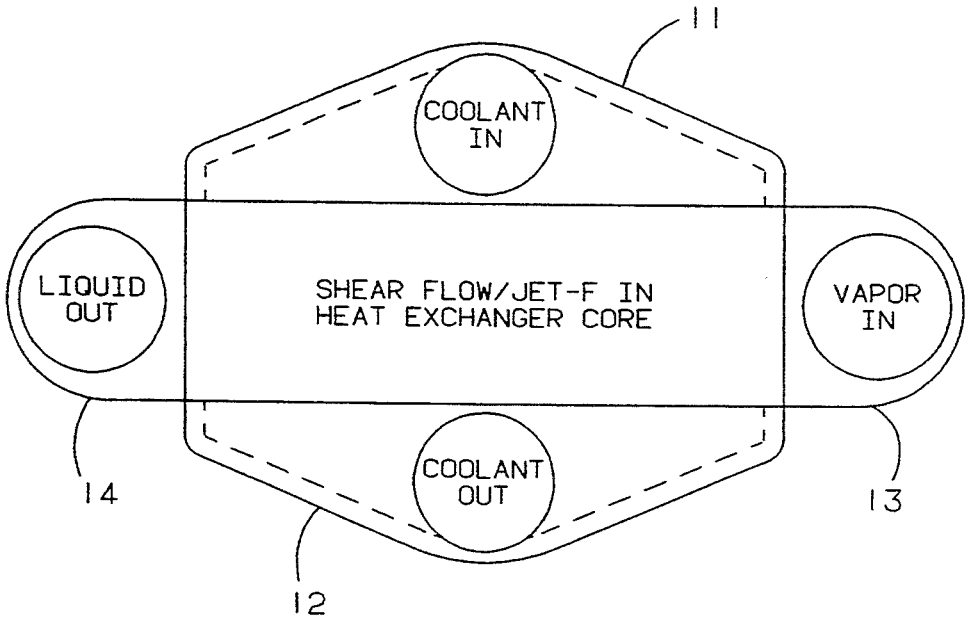
FIG. 2 is an end overall view of the invention.
Figure 3:
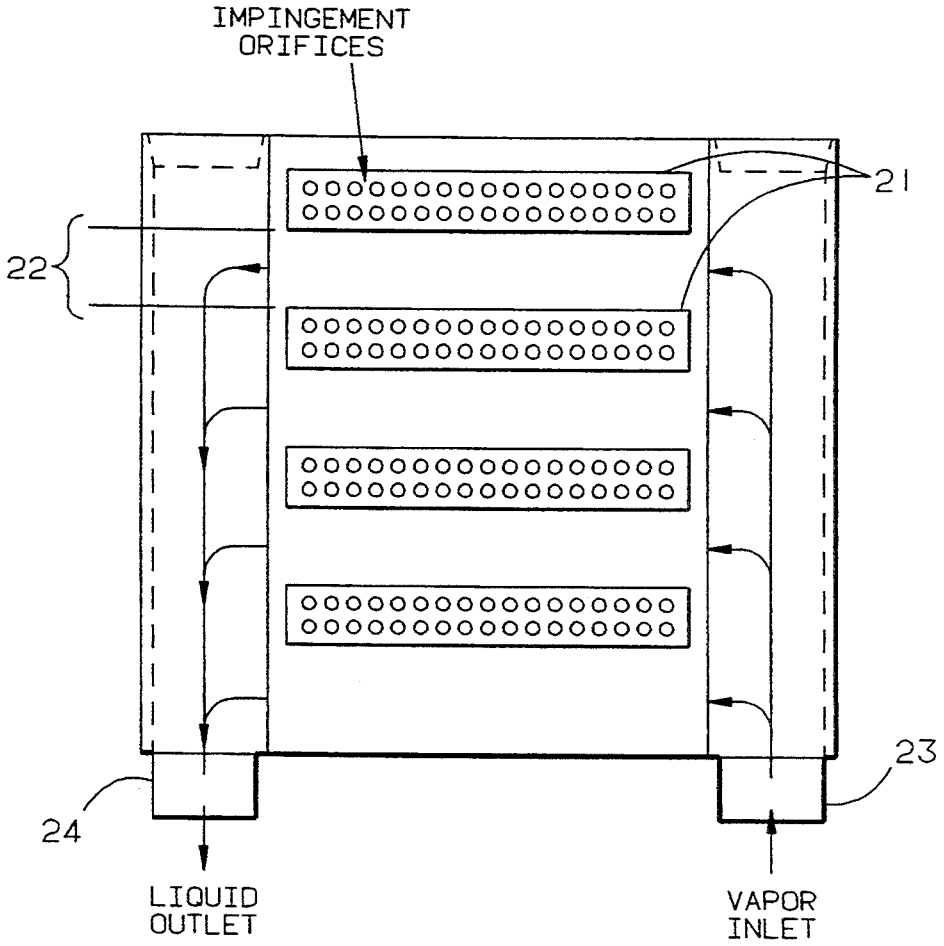
FIG. 3 is a side overall view of the invention.
Figure 4:
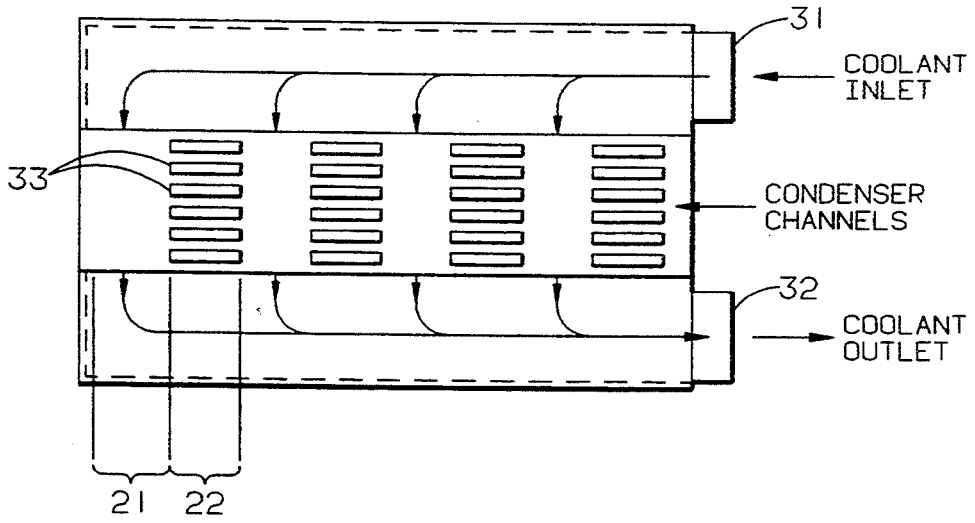
FIG. 4 is an overall view of another side of the invention.
Figure 5A:
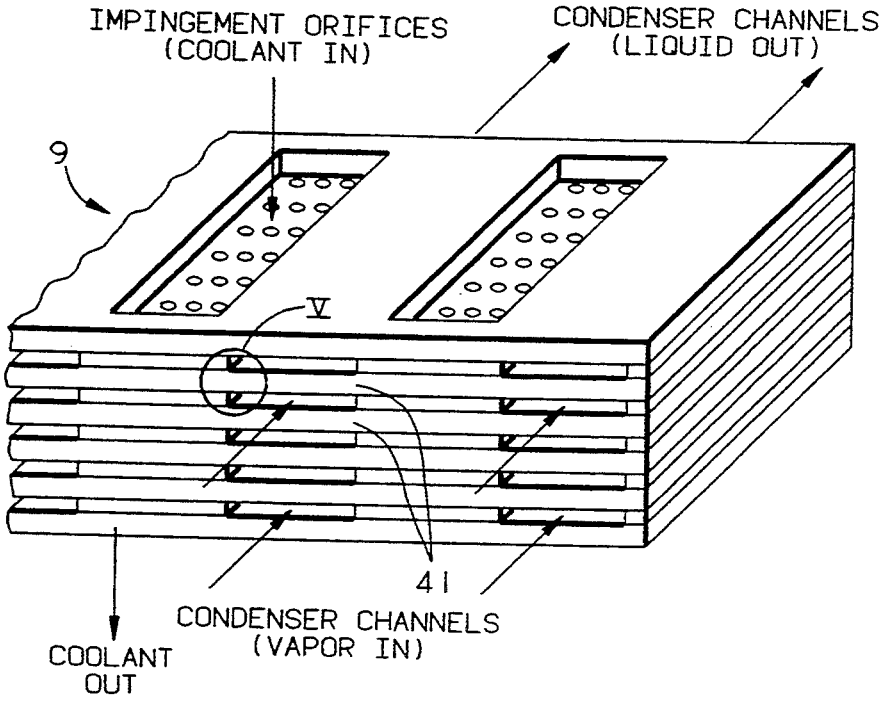
FIG. 5*a* is an isometric view of a preferred embodiment of the invention corresponding to FIG. 2, but with manifolds removed.

Referring briefly now to FIG. 5*a*, a completed view of the core 9 of the condenser according to the invention is isometrically illustrated, including depiction of refrigerant and coolant paths through the core. FIGS. 2–4 include manifolds or shrouds for establishing these paths of refrigerant and coolant through the core.

FIG. 2 shows an end view of the invention with all manifolds in place. Typically, the manifolds will include a coolant inlet manifold 11, a coolant outlet manifold 12, a refrigerant inlet manifold 13 and a refrigerant outlet manifold 14. Coolant manifolds may be omitted for ambient gas cooling if the ambient conditions provide adequate pressure and flow rate. Additional manifolds may be included if plural refrigerants or coolants are to be brought into thermal communication in the same condenser or for forming redundant systems. The construction of these manifolds is not critical to the operation of the invention and they may be fitted to the core, included in the laminated structure or formed integrally with the core or each other (e.g. as a core housing) as may be deemed desirable. Similarly the particular means or process by which they are affixed to the core 9 is not critical to the practice of the invention. As illustrated, the manifolds may be tapered or formed in other shapes to provide a substantially equal pressure distribution to the jet fin structures or plural refrigerant passages as are preferably provided according to the invention. Shape of the manifolds may also be dictated by the required overall dimensions of the condenser. In the preferred embodiment, where tapered refrigerant passages are employed, the refrigerant manifolds 13, 14 can be advantageously formed in a tapered shape which is complementary to the resulting taper of the core to form a compact, generally rectangular overall shape of the condenser.

FIG. 3 shows a side view of the invention with the coolant manifolds-omitted for clarity. This view is arbitrarily designated a side view since it is an advantage of the present invention that the orientation with respect to gravitational or other acceleration forces is unimportant to the efficacy of the invention or the efficiency of operation thereof. With a coolant manifold removed, a plurality of jet fin structures 21 are visible. In accordance with the invention, the jet fin structures are alternated with regions 22 in which the refrigerant passages are formed. The direction of refrigerant flow from inlet 23 to outlet 24 is illustrated by arrows.

FIG. 4 shows a view of another side of the invention with the refrigerant manifolds omitted for clarity. This view is also arbitrarily designated as a side view for the reasons stated with regard to FIG. 3. With a refrigerant manifold removed, ends of refrigerant passages 33 are visible, as is the alternating arrangement of jet fin structure areas 21 and refrigerant passage areas 22. The direction of coolant flow from inlet 31 to outlet 32 is also illustrated by arrows.

Referring now to FIG. 5*a*, a preferred form of the core of the condenser according to the invention is shown. This embodiment is preferred principally because it is formed of apertured lamina as shown in FIGS. 6*a–6d* and will be discussed with regard thereto. In FIG. 5*a*, a preferred laminated structure is shown. Construction of the core from a plurality of apertured lamina provides convenience in establishing correct registration of the impingement orifices of the jet fin structure and apertures 41 which will form the refrigerant-confining passages as will be discussed more fully with regard to FIG. 5*b*. Surface treatments for enhancing surface area and fluid turbulence can also be easily applied to the separate layer surfaces prior to assembly and bonding, such as by brazing. Compression by through bolting or riveting or by use of a frame-like structure is also a suitable form for maintaining the layers or plates together but is not preferred because of the differential pressures which may be encountered, causing leakage or mixing of the coolant and refrigerant, contaminating either or both.

Figure 5B:
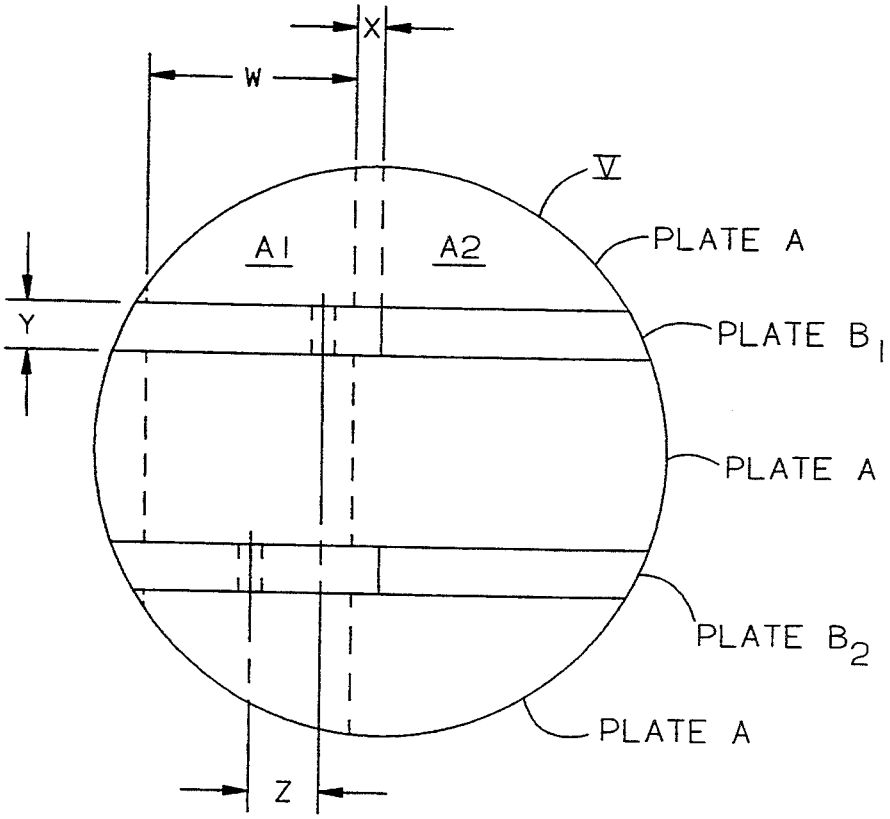
FIG. 5*b* is an enlarged view of an area of FIG. 5*a*, FIGS. 6*a*, 6*b*, 6*c*and 6*d* illustrate preferred forms of the lamina which may be included in various preferred forms of the invention.
Figure 6A:
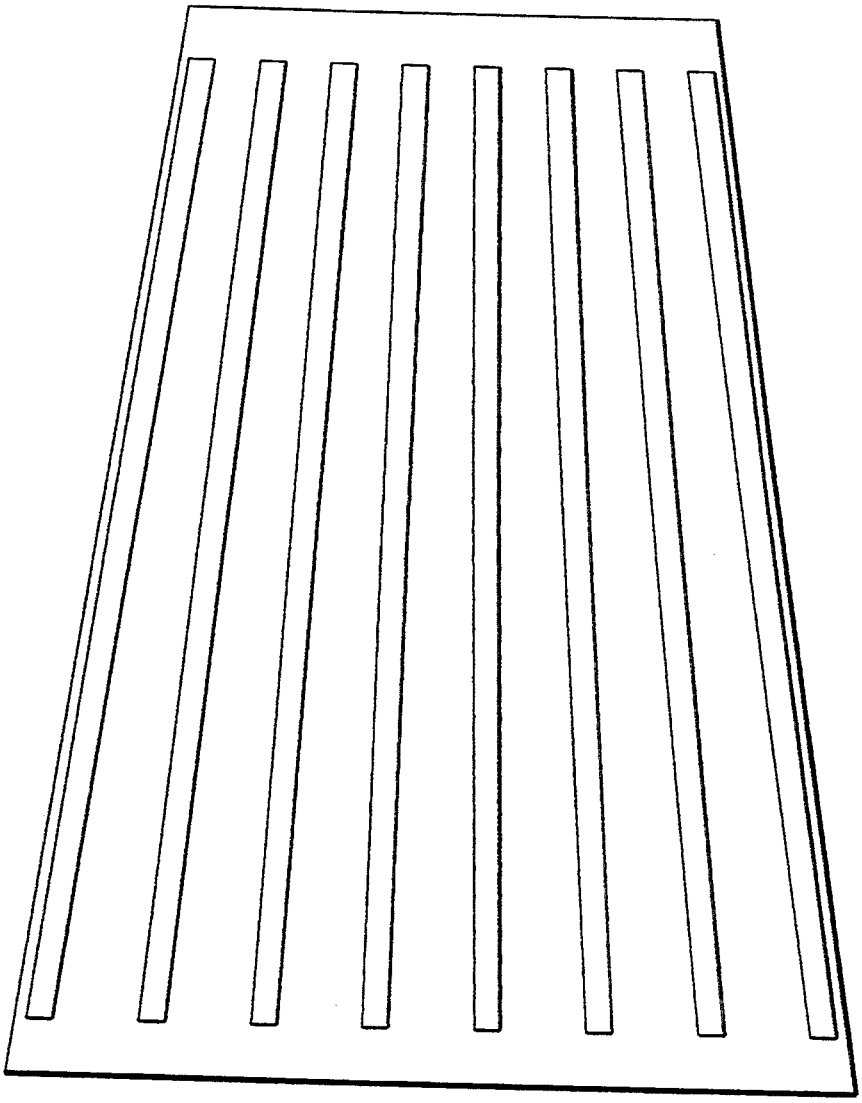
Figure 6B:
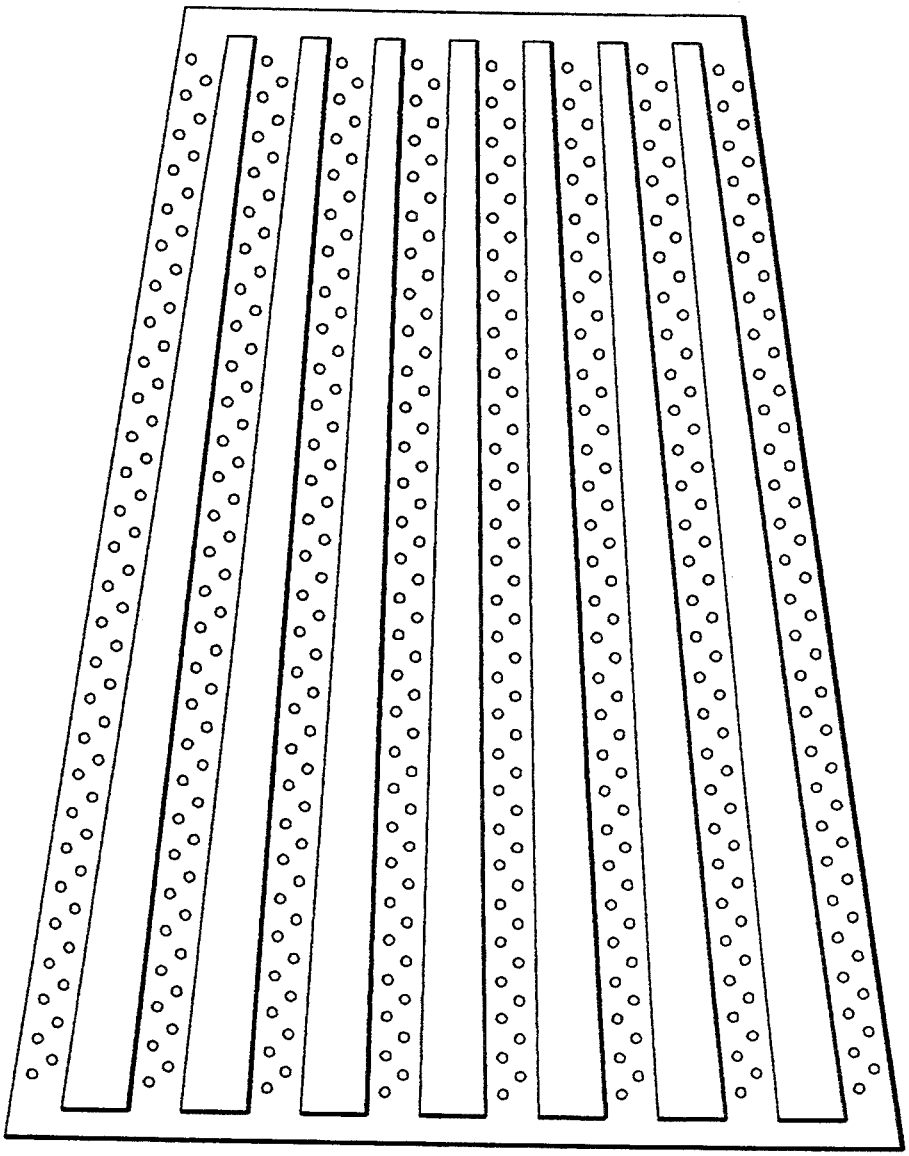
Figure 6C:
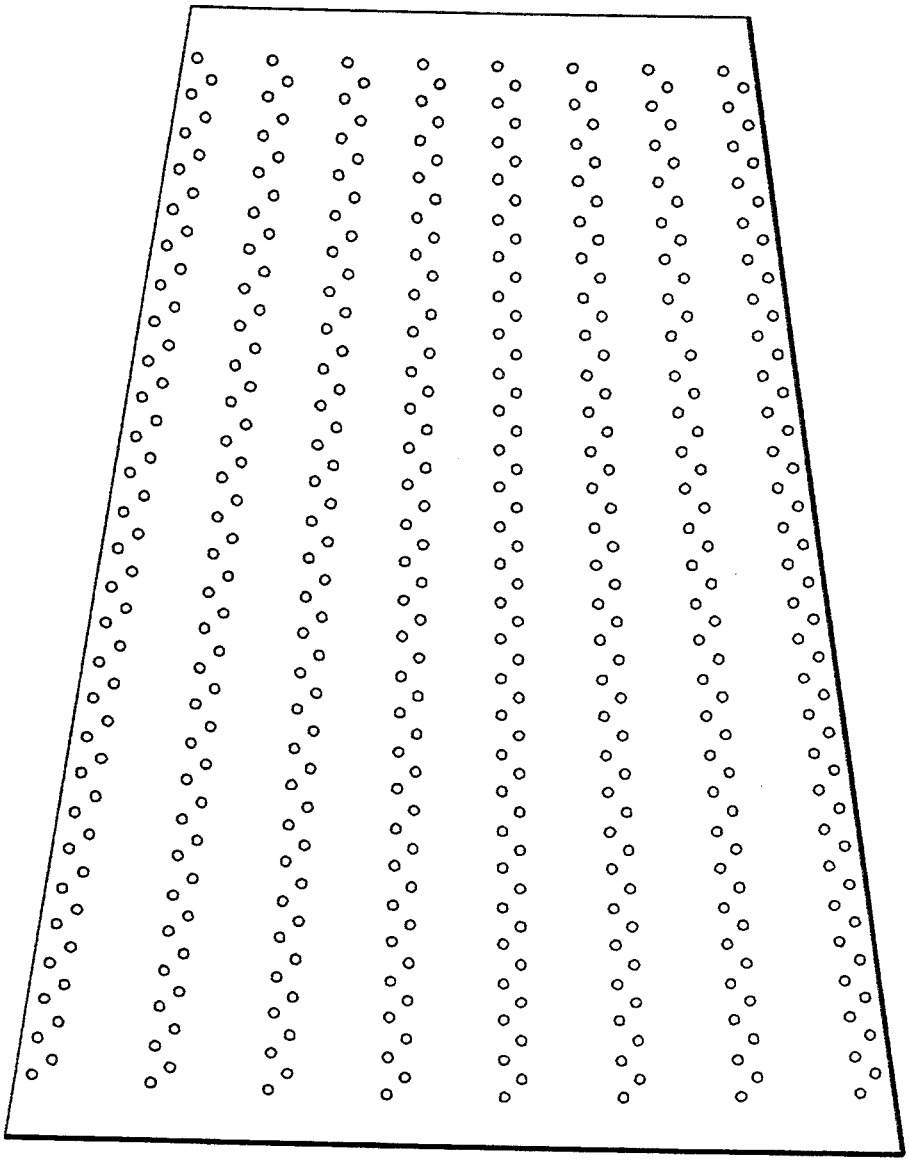

Referring now to FIG. 5*b* which illustrates an enlarged portion of FIG. 5*a* indicated by circle V, the formation of the core 9 of the invention from a sequence of the plates illustrated in FIGS. 6*a* –6*d* is shown. The particular form of core structure illustrated in FIG. 5*a* is specifically formed of only plates of types A and B. Plate A, shown in FIG. 6*a* is basically a spacer plate to provide spacing for the jet fin structure located at the elongated apertures at location A1 to the left of the dashed line indicating the boundary of an elongated aperture. The plate material between the elongated apertures, at location A2 will form the major surfaces of the refrigerant passages in the assembled core. Plate B, shown in FIG. 6*b* has apertures forming the impingement orifices. It is important to note that plate B will either have two forms or have the impingement orifices located in such a way that the skewing of locations of impingement orifices, illustrated at z of FIG. 5*b*, can be achieved by reversing to orientation of the plate. Therefore, in FIG. 5*b*, Plates B1 and B2 are indicated. Dimensions x and y of FIG. 5*b* are limited in minimum dimension by the heat conductivity of the plates. For aluminum, a typical value for dimension x is 0.01 to 0.05 inches and a typical value for y is also 0.01 to 0.05 inches. Width of the jet fin structure, w, is also limited by heat conductivity of the plates and typical values would be in the range of 0.1 to 0.5 inches. However, it is to be noted that the structural strength of the material also affects dimensions w and y. The use of a material such as stainless steel for layer B can permit the reduction of y to a typical value of 0.002 inches. However, heat conductivity limits dimension w to values in the range given above, particularly for such thin lamina formed of stainless steel.

While the particular preferred embodiment shown in FIG. 5*a* is particularly comprised of an alternating sequence of layers A and B, an alternate form of the preferred embodiment which has condensing, refrigerant-containment passages in the spacer plate can be formed by an alternating sequence of layers C and D. Relative to the embodiment illustrated in FIG. 5*a*, a core with refrigerant passages in the spacer plate could be advantageous if the layers having the impingement orifices are thinner than is desirable as a minimum dimension of the refrigerant passages, causing slug flow to develop more easily. Also, the thermal path from the major surfaces of the refrigerant passages to the jet fin structure does not cross a boundary between layers. On the other hand, the thinness of the layers containing the impingement orifices (dimension y) may restrict heat flow in this embodiment. In summary, the relative desirability of each of these two layerings will depend principally on the thickness of the jet fin orifice lamina, the viscosity and surface tension of the liquid phase of the refrigerant, the differential pressure across the condenser in the refrigerant path and the construction method used to form the lamina into a condenser core and the resulting thermal conductivity between lamina as well as other minor design factors.

Other arrangements of lamina stacking order are also possible. For instance, if it should be desired to form the core with multiple impingement surfaces per condensing passage, a typical stacking order would be C, D, B, D, B, D, B, D, C, D, B, D . . . , possibly with a greater number of repetitions of layers B and D between occurrences of layer C. If multiple condensing passages are desired for each impingement surface, a typical stacking order of C, D, A, D, A, D, A, D, C, D, A, D . . . may be employed, again with a greater number of repetitions of layers A and D being possible, if desired. These particular possibilities may be useful in avoiding limitations on heat exchanger geometry imposed by the heat conductivity of the lamina or in adjusting the effective hydraulic diameter of the refrigerant passages to alter the Froude number, Fr, in some applications. Other lamina patterns and stacking arrangements may be employed with appropriate manifolding to provide for either a plurality of refrigerants or a plurality of coolants to be circulated through the same condenser. Such an arrangement may be desirable to provide equalization of temperature of a plurality of fluids in a plurality of systems. Therefore, it is seen that the invention provides for a plurality of variations which can accommodate a wide range of specific heats and viscosities of refrigerants and coolants and the structure (e.g. the number of repetitions of the above sequences of lamina) can be repeated to whatever degree is deemed necessary to transfer the amount of heat required. In any configuration, the condenser according to the invention remains compact since jet fin lamina can be provided at a pitch of at least 50 per inch or 100 lamina per inch, forming 50 condensing passages per inch of thickness of the condenser core. As will be understood, the manifolds are relatively variable in dimensions, within the scope of the invention and will represent a relatively constant and potentially negligible fraction of the overall dimensions of the device.

Figure 6D:
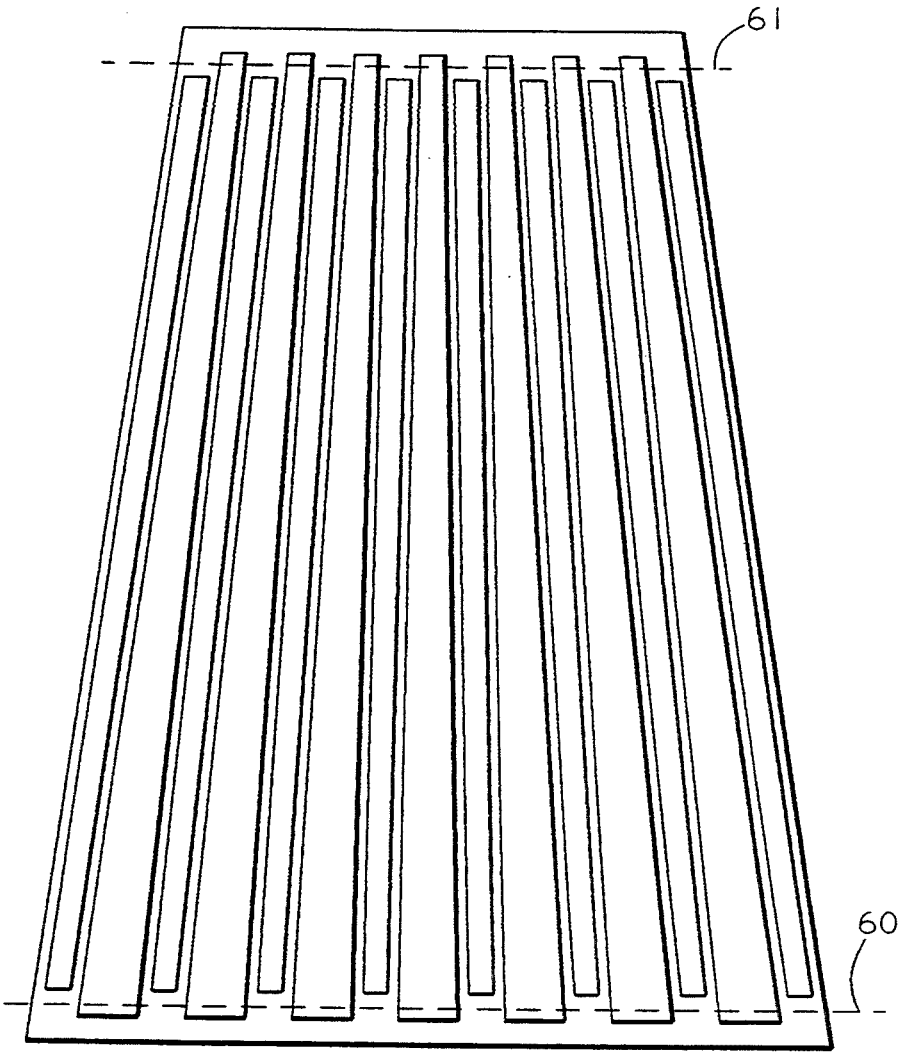

It will be noted, particularly from FIG. 6*d* that some of the openings or apertures are generally rectangular, with parallel major sides while others are tapered into a generally trapezoidal form. As noted above, the volume of the refrigerant will diminish during passage through the condenser and tapering of the apertures which form the refrigerant passages is desirable to maintain vapor phase refrigerant flow velocity. The optimum degree of tapering can be readily calculated from the characteristics of the refrigerant and the amount of heat exchange for which the condenser is designed. The rate of heat exchange and resulting amount of condensation and volume change along the passages should be matched by changes in the cross-sectional area of the passages and may be non-linear. However, since the rate of heat exchange is relatively uniform in the preferred embodiment of the invention, a linear taper is shown. The tapering of the apertures need not result in the overall trapezoidal shape of the lamina and, hence, the condenser core, but overall core volume will be minimized if this is done.

It will also be noted from FIG. 6*d* that the rectangular apertures are shorter in major dimension than the trapezoidal apertures. This permits the core, after the lamina are assembled and bonded, to be trimmed or cut at locations corresponding to dotted lines 60 and 61 to complete formation of the refrigerant-confining passages. Openings to these passages could, of course, be formed in other ways, such as drilling or selectively removing material only at the passage locations (e.g. resulting in a crenelated form of the core edge) with or without providing a difference in length of the major dimension of the apertures.

Figure 7:
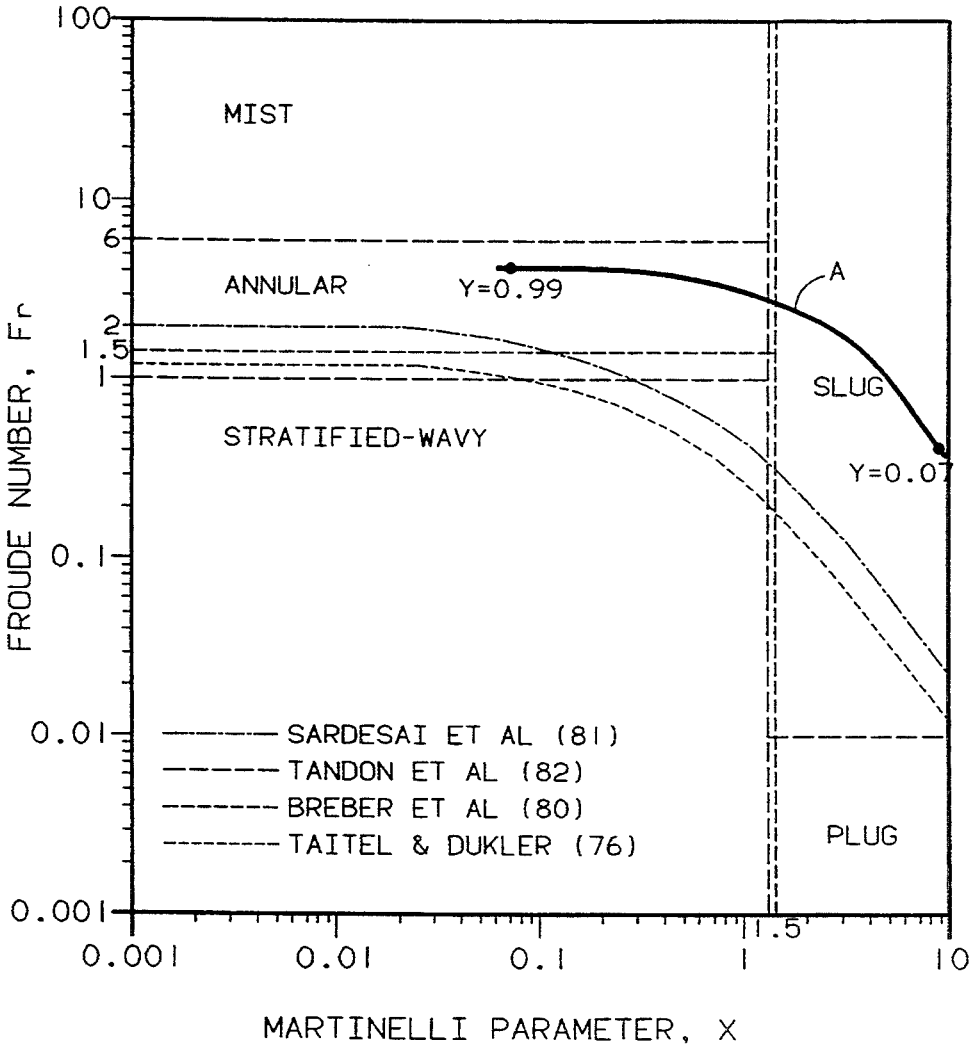
FIG. 7 is a diagram useful in explaining the operation of the invention.

To facilitate appreciation of the improved performance of the present invention, reference will again be made to FIG. 7 which shows a map of areas representing various flow regimes in terms of parameters recognized in the art as the Martinelli parameter, X, and the Froude Number, F. As indicated above, the Froude number will vary directly with the quality and mass velocity and inversely with the square root of the gravitational field, vapor and liquid density and the hydraulic diameter of the conduit. Curve A represents the entire two phase length of a refrigerant passage in the heat exchanger according to the invention. The quality of the fluid at the inlet is indicated at a quality of 0.99 at the left end of curve A and the quality of the fluid at the outlet is indicated at a quality of 0.01 at the right end of curve A. It is clearly seen from FIG. 7 that the flow regime at any point in the refrigerant containing passages is always in a regime which is shear flow dominated, being either annular or so-called high velocity slug flow, thus maintaining a flow regime which results in high heat transfer efficiency. It should be noted that the decrease of effective hydraulic diameter and the maintaining of high flow velocity by the tapered tubes each contribute to effectively counteracting the decrease in quality of the fluid as condensation occurs and curve A is substantially linear and horizontal to values of the Martinelli parameter, X, very closely approaching 1.5.

It should also be noted that the performance of the invention and the flow regime map, as well, are depicted at an acceleration or gravity field of 1 g. Since the Froude number varies inversely with the acceleration to which the conduit is subjected, reduced gravitational force or acceleration will move the performance curve A upwardly. Conversely, an increased acceleration will tend to move the curve A downwardly. Therefore the distance on the flow regime map in a vertical direction between curve A and the Sardesai curve is a good measure of the tolerance of the heat exchanger of the invention to acceleration and increased g-forces. It is significant in this regard that the distance between these curves actually diverges as quality of the fluid decreases (e.g. the proportional amount of liquid phase refrigerant increases). This result is counter-intuitive since the liquid phase of the refrigerant is more dense than the vapor phase and therefore seemingly more affected by accelerations while, in the operation of the invention, the desirable contrary result prevails. Since refrigerant pressure at the inlet is high enough to maintain velocity of the slug flow at the outlet and curve A is very remote from the plug flow regime area of FIG. 7, shear force dominated flow can be maintained at that same inlet pressure throughout the refrigerant-containing passages and heat exchange performance is very stable to extremely high acceleration values.

Therefore, it is seen that the invention provides a condenser structure which is economical to fabricate in a plurality of configurations and uniformly efficient over a wide range of acceleration forces.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A condenser of a heat exchange system comprising, in combination, a jet fin structure for heat exchange with a single phase coolant, at least one refrigerant-confining passage for heat exchange with a two phase refrigerant, and means for thermally connecting said jet fin structure and said at least one refrigerant-containing passage, wherein said at least one refrigerant-confining passage includes means for maintaining vapor flow velocity within said at least one refrigerant-confining passage.

2. A condenser as recited in claim 1, wherein at least one of said jet fin structure and said at least one refrigerant-confining passage is constructed of a plurality of perforated lamina.

3. A condenser as recited in claim 1, wherein each of said jet fin structure and said at least one refrigerant-confining passage are constructed of a plurality of perforated lamina.

4. A condenser as recited in claim 3, wherein said lamina include at least one of a first type of layer having at least one elongated aperture at a position corresponding to said jet fin structure, a second type of layer having at least one elongated aperture at a position corresponding to said refrigerant-containing passage and at least one jet aperture at a position corresponding to said jet fin structure, a third type of layer having at least one jet aperture at a position corresponding to said jet fin structure, and a fourth type of layer having at least one elongated aperture at a position corresponding to said refrigerant-containing passage and at least one elongated aperture at a position corresponding to said jet fin structure.

5. A condenser as recited in claim 4, wherein said lamina include an alternating sequence of said first and second types of layers.

6. A condenser as recited in claim 4, wherein said lamina include an alternating sequence of said third and fourth types of layers.

7. A condenser as recited in claim 4, wherein said lamina include an alternating sequence of said third and fourth types of layers and at least one of said first type of layer.

8. A condenser as recited in claim 4, wherein said lamina include an alternating sequence of said third and fourth types of layers and at least one of said second type of layer.

9. A condenser as recited in claim 3, wherein said means for thermally connecting said jet fin structure and said at least one refrigerant-containing passage includes overlapping portions of said lamina.

10. A condenser as recited in claim 9, wherein said overlapping portions of said lamina are brazed together.

11. A condenser as recited in claim 1, wherein said vapor flow velocity maintaining means comprises a tapered geometry of said at least one refrigerant-confining passage.

12. A condenser as recited in claim 11, wherein said tapering geometry of said refrigerant-confining passages is substantially linear.

13. A method of forming a heat exchanging structure from lamina including a first type of layer having at least one elongated aperture at a position corresponding to a jet fin structure, a second type of layer having at least one elongated aperture at a position corresponding to a refrigerant-containing passage and at least one jet aperture at a position corresponding to said jet fin structure, a third type of layer having at least one jet aperture at a position corresponding to said jet fin structure, and a fourth type of layer having at least one elongated aperture at a position corresponding to said refrigerant-containing passage and at least one elongated aperture at a position corresponding to said jet fin structure, said method comprising the steps of positioning at least two of said first, second, third and fourth types of layers in a predetermined sequence, bonding said at least two of said first, second, third and fourth types of layers together, and forming at least two openings in an edge of at least one of layer in a position to communicate with said at least one refrigerant containing passage.

14. A method as recited in claim 13, wherein said forming step includes the step of removing at least one edge of at least one said layer.

15. A method as recited in claim 13, wherein said positioning step includes forming an alternating sequence of said first and second types of layers.

16. A method as recited in claim 13, wherein said positioning step includes forming an alternating sequence of said third and fourth types of layers.

17. A method as recited in claim 13, wherein said positioning step includes forming a sequence including an alternating sequence of said third and fourth types of layers and at least one of said first type of layer.

18. A method as recited in claim 13, wherein said positioning step includes forming a sequence including an alternating sequence of said third and fourth types of layers and at least one of said second type of layer.

* * * * *